US009010890B2

(12) United States Patent
Eckartsberg

(10) Patent No.: US 9,010,890 B2
(45) Date of Patent: Apr. 21, 2015

(54) DOMESTIC APPLIANCE COMPRISING A SUPPORT SYSTEM

(75) Inventor: Peter Eckartsberg, Aalen (DE)

(73) Assignees: BSH Bosch und Siemens Hausgeräte GmbH, Munich (DE); Miele & Cie. KG, Gütersloh (DE)

( * ) Notice: Subject to any disclaimer, the term of this patent is extended or adjusted under 35 U.S.C. 154(b) by 1180 days.

(21) Appl. No.: 12/523,746

(22) PCT Filed: May 8, 2007

(86) PCT No.: PCT/EP2007/054446

§ 371 (c)(1),
(2), (4) Date: Jul. 20, 2009

(87) PCT Pub. No.: WO2008/095545

PCT Pub. Date: Aug. 14, 2008

(65) Prior Publication Data

US 2009/0302726 A1 Dec. 10, 2009

(30) Foreign Application Priority Data

Feb. 6, 2007 (DE) ..... 10 2007 005 949

(51) Int. Cl.

| | |
|---|---|
| ***A47B 96/04*** | (2006.01) |
| ***F25D 25/02*** | (2006.01) |
| ***A47B 57/42*** | (2006.01) |
| ***A47B 57/52*** | (2006.01) |
| ***F25D 23/06*** | (2006.01) |

(52) U.S. Cl.

CPC ..... *F25D 25/02* (2013.01); *A47B 57/425* (2013.01); *A47B 57/52* (2013.01); *A47B 2210/17* (2013.01); *F25D 23/067* (2013.01); *F25D 2400/18* (2013.01)

(58) Field of Classification Search

USPC ..... 312/408, 404, 351, 405.1, 321.5; 108/106–108, 147.17; 248/235, 241, 248/243, 244, 250; 211/103, 90.02

See application file for complete search history.

(56) References Cited

U.S. PATENT DOCUMENTS

| | | | | | |
|---|---|---|---|---|---|
| 1,847,486 | A | * | 3/1932 | Keil | 248/243 |
| 2,355,651 | A | * | 8/1944 | Hormes | 248/243 |
| 2,744,714 | A | * | 5/1956 | Parke | 248/245 |
| 2,815,649 | A | | 12/1957 | Di Angelus et al. | |
| 3,219,405 | A | * | 11/1965 | Costantini et al. | 312/351 |
| 3,234,897 | A | | 2/1966 | Berk | |
| 3,261,585 | A | | 7/1966 | Costantini et al. | |
| 3,316,863 | A | * | 5/1967 | Zock | 108/108 |
| 3,492,766 | A | * | 2/1970 | Andrews | 52/36.6 |
| 3,647,075 | A | * | 3/1972 | Aue | 211/153 |
| 3,730,477 | A | * | 5/1973 | Wavrunek | 248/243 |

(Continued)

*Primary Examiner* — Daniel J Troy
*Assistant Examiner* — Hiwot Tefera
(74) *Attorney, Agent, or Firm* — Nixon & Vanderhye P.C.

(57) ABSTRACT

A cabinet-like domestic appliance is provided having an interior in which a height-adjustable support system is mounted. The support system includes a vertical rail provided with a plurality of snap-in recesses and a supporting arm that has a plurality of projections each of which engages with one of the snap-in recesses. The rail includes a profiled element that is immobilized on a wall via an at least one fastener and a strip is provided that can be vertically displaced in the profiled element between a position in which the at least one fastener is accessible through an opening on one side of the profiled element that faces away from the wall and another position in which the at least one fastener is concealed behind the strip.

16 Claims, 5 Drawing Sheets

(56) References Cited

U.S. PATENT DOCUMENTS

| | | | | | |
|---|---|---|---|---|---|
| 3,908,320 | A | * | 9/1975 | Hogue | 52/36.5 |
| 4,212,445 | A | * | 7/1980 | Hagen | 248/245 |
| 4,244,637 | A | * | 1/1981 | Boorman, Jr. | 312/350 |
| 4,441,300 | A | * | 4/1984 | Varon et al. | 52/481.2 |
| 4,443,979 | A | * | 4/1984 | Varon et al. | 52/36.6 |
| 4,570,390 | A | * | 2/1986 | Wendt | 52/36.6 |
| 4,588,156 | A | * | 5/1986 | Doke et al. | 248/243 |
| 4,753,354 | A | * | 6/1988 | Patterson et al. | 211/26 |
| 5,004,198 | A | * | 4/1991 | Jager | 248/224.8 |
| 5,004,302 | A | * | 4/1991 | Stocking et al. | 312/408 |
| 5,074,422 | A | * | 12/1991 | Holtz | 211/187 |
| 5,104,272 | A | * | 4/1992 | Dupont et al. | 411/339 |
| 5,185,971 | A | * | 2/1993 | Johnson, Jr. | 52/36.6 |
| 5,361,599 | A | | 11/1994 | Dasher | |
| 5,517,795 | A | * | 5/1996 | Doke | 52/36.4 |
| 5,803,274 | A | | 9/1998 | Scheveloff | |
| 5,927,840 | A | * | 7/1999 | Bzowski | 312/321.5 |
| 6,112,913 | A | * | 9/2000 | Rindoks et al. | 211/90.02 |
| 6,196,141 | B1 | * | 3/2001 | Herron et al. | 108/108 |
| 6,644,609 | B1 | | 11/2003 | Scott | |
| 7,337,730 | B2 | * | 3/2008 | Bienick et al. | 108/108 |
| 7,497,533 | B2 | * | 3/2009 | Remmers | 312/404 |
| 7,752,818 | B1 | * | 7/2010 | Roegge et al. | 52/235 |
| 7,784,626 | B2 | * | 8/2010 | Jacques et al. | 211/103 |
| 2004/0195480 | A1 | * | 10/2004 | Vardaro et al. | 248/250 |
| 2005/0150436 | A1 | * | 7/2005 | Marchetta et al. | 108/108 |
| 2006/0163985 | A1 | * | 7/2006 | Blersch et al. | 312/408 |
| 2006/0255221 | A1 | * | 11/2006 | Tseng | 248/235 |
| 2008/0030114 | A1 | | 2/2008 | Becke | |
| 2009/0195129 | A1 | * | 8/2009 | Osawa et al. | 312/209 |
| 2010/0164342 | A1 | * | 7/2010 | Hagele et al. | 312/408 |

* cited by examiner

DOMESTIC APPLIANCE COMPRISING A SUPPORT SYSTEM

This application is a U.S. National Phase of International Application No. PCT/EP2007/54446, filed May 8, 2007, which designates the U.S. and claims priority to German Application No. 102007005949.5, filed Feb. 6, 2007, the entire contents of each are hereby incorporated by reference.

The present invention relates to a cabinet-like household appliance, in particular a refrigerator or freezer cabinet, having an interior in which a height-adjustable support system is mounted. A household appliance of this kind is disclosed in DE 10 2004 058199 A1, for example. The support system of said household appliance comprises a vertical rail, this being provided with a plurality of locating steps, and at least one supporting arm which has at least one projection that engages into one of the locating steps.

One problem of this form of construction is that the rail is subjected to considerable bending moments as a result of the load that is transmitted by the supporting arm, and must be securely anchored to the wall in order to be capable of bearing the loads that occur. A simple screw fastening of the rail to the wall is considered to be aesthetically unsatisfactory, since the heads of the screws remain visible in the interior. The object of the present invention is therefore to provide a household appliance of the type described in the introduction, in which the vertical rail is securely but invisibly anchored to the wall.

The object is achieved according to the invention in that the rail comprises a profiled element, this being immovably fixed to the wall by at least one screw, and a strip which can be vertically displaced in the profiled element between a position in which the screw is accessible through an opening on a side of the profiled element that faces away from the wall, and a position in which the screw is concealed behind the strip.

If the locating steps are apertures in each case, the screw can be arranged in such a way that it is accessible through one of the apertures and is therefore inconspicuously placed even when it is not concealed by the strip.

The locating steps can be formed in the displaceable strip itself.

If the locating steps are formed in a bridge of the profiled element, the strip can be arranged between the wall to which the rail is fixed and the bridge.

According to a preferred development, an opening is formed on a side of the profiled element that faces the wall and, when the screw is loosened, the profiled element can be displaced on the wall between a position in which a head of the screw passes through a wide entry section of the opening and a position in which the head is caught in a narrow section of the opening. This allows the screws to be attached to the wall before the profiled element, and the profiled element then to be hung onto the screws. In this case it is not necessary to provide openings on the front side of the profiled element which are wide enough for the screw heads to pass through.

In order to make the hanging of the rail as inconspicuous as possible, the profiled element preferably has an inner wall which is parallel to the wall having the opening and in turn has a hole that is aligned with the narrow section of the opening. The wider section of the hole, on the other hand, can remain concealed behind the wall.

If, in addition, the hole is smaller than the head of the screw itself, the screw head as such is also never fully visible, but preferably all that can be seen is a mating contour of the screw, such as e.g. a slot, a cross recess or a hexagonal socket, for a screw fixing tool.

The locating steps are preferably arranged inconspicuously on a base surface of a groove which is open toward the interior.

Said groove can advantageously be undercut, and the supporting arm can have at least one projection which is held in the undercut groove. This ensures that the supporting arm cannot work free of the rail unintentionally, and after the projection is released from the locating step, it can conveniently and safely be displaced vertically, with the projection sliding along in the undercut groove.

The vertical rail can be fastened to a door of the household appliance, the supporting arm being used in this case for holding a door storage unit. Alternatively, it can also be fixed within the body of the household appliance such that it can be used for supporting shelves.

Provision is preferably made for two vertical rails in each case and for two supporting arms which are connected to a rigid unit and engage into one of the rails in each case. If at least one of the rails has a vertical groove which is open toward the interior and into which a guide projection of one of the supporting arms extends, this makes it easier to maintain a horizontal orientation of the unit when adjusting the height, such that when a desired height is reached, the projections of both supporting arms engage at the same height into locating steps of the rails, without a user needing to pay particular attention in this regard.

If the wall of the household appliance comprises, in a per se known manner, an outer skin, an inner container and an insulating material layer between these, the inner container is reinforced by a plate, preferably at the height of the screw, said plate being arranged between inner container and insulating material layer and therefore being invisible externally.

The plate can have a greater wall strength and/or load bearing capacity than the inner container itself. Consequently, it can be beneficial to provide a thread for holding the screw on the plate itself.

The subject matter of the invention is additionally to provide a method for assembling a household appliance of the type described above, said method comprising the following steps:

a) joining an outer wall and an inner container to form a hollow-walled appliance body, wherein said inner container has at least one opening which is provided with a screw thread;
b) positioning a screw in the opening;
c) foaming the hollow wall of the appliance body;
d) positioning the rail and fastening the rail by tightening the screw in the opening.

By virtue of the screw being positioned in the screw thread opening before the foaming, the opening is sealed and no foam can escape. Consequently, no backing parts are required on the inner container in order to keep the foam away from the opening.

In order to make the opening reliably leak-proof, the screw is preferably tightened in the opening before step c). It must then be temporarily removed or at least slackened again in order that the rail can be positioned.

Further features and advantages of the invention may be derived from the following description of exemplary embodiments with reference to the attached figures, in which.

Figure 1:
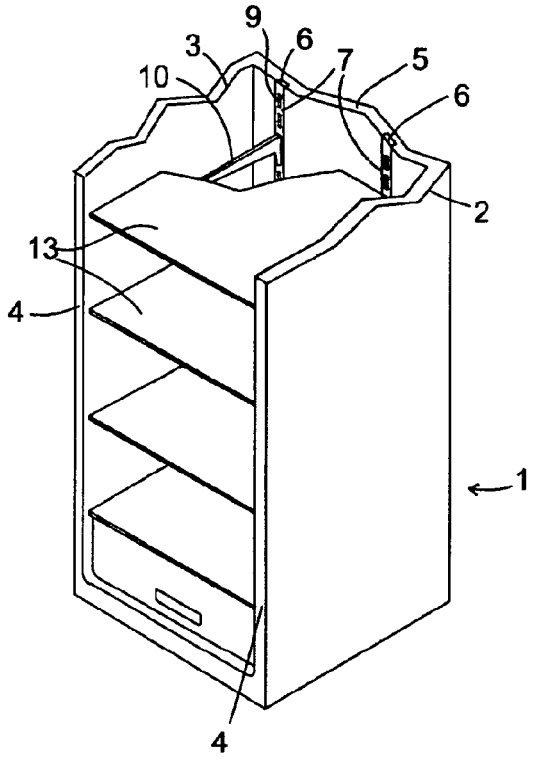
FIG. 1 shows a perspective fragmentary view of a first embodiment of a refrigeration appliance according to the invention.

In a per se known manner, the refrigeration appliance body 1 shown in a partially fragmented view in FIG. 1 comprises an outer skin 2 which is assembled from rigid elements such as, for example, sheets cut to size, and an inner container 3 which delimit walls 4, 5 that are filled with insulating foam material. Formed at the rear wall 5 in the inner container 3 are two vertical grooves 12 (see FIG. 2) which extend over the full height of the interior and into which hollow support rails 6 having a rectangular cross-section are inserted. Hooked into the support rails 6 are supporting arms 10 which, as indicated in FIG. 1, can carry loosely placed shelves 13 or can be integrated as a pair in each case with a shelf to form a rigid unit.

Figure 2:
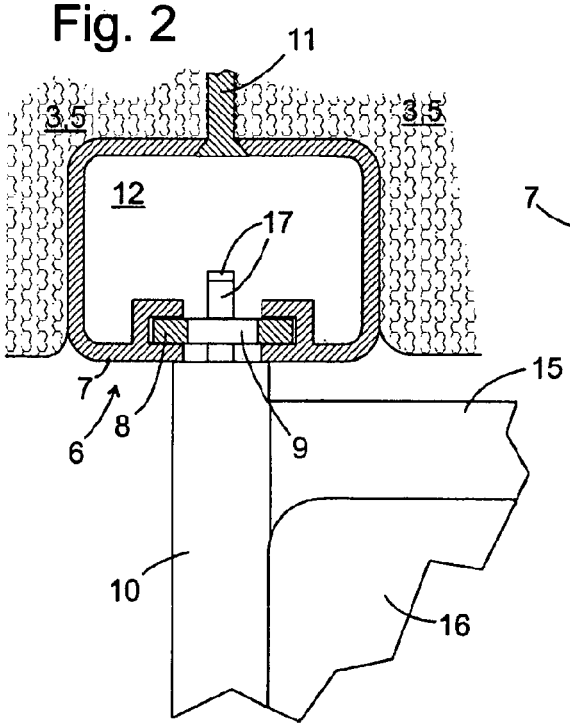
FIG. 2 shows a horizontal section through a vertical rail of the refrigeration appliance and its surroundings.

FIG. 2 shows a horizontal section through one of the support rails 6 along a plane above a supporting arm 10 which is hung into the support rail 6, and through the groove 12 in the inner container 3, which groove 12 receives the support rail 6. As shown in this figure, the two support rails 6 each comprise an outer profile 7 of approximately C-shaped cross-section, wherein the open side of the C profile faces toward the interior of the body 1, and a strip 8 which is guided in two opposing grooves of the limbs of the outer profile 7 in such a way that it can be vertically displaced. The strip 8 is provided with apertures 9 at regular intervals, one of these being shown in the section in FIG. 2.

A supporting arm 10 that is shown as a fragment in plan view is provided with two hooks 17 which engage into other apertures 9 disposed lower down in the strip 8.

Figure 3:
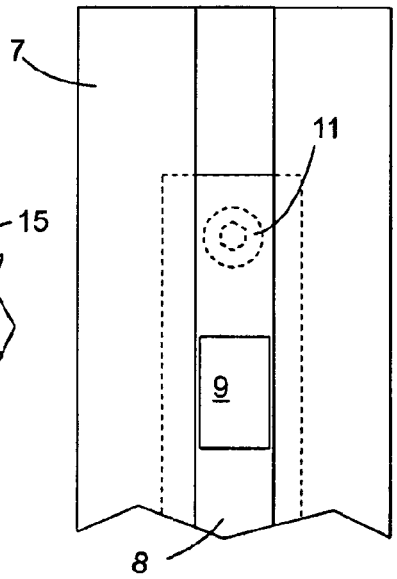
FIG. 3 shows a front view of one part of the rail.

While the outer profile 7 extends over the full height of the inner container 3, the strip 8 is slightly shorter. As can be seen in the front view of the upper region of the support rail 6 shown in FIG. 3, the strip 8 does not extend as far as the top end of the outer profile 7. Accordingly, the strip 8 can be vertically displaced in the outer profile 7 and can be raised into a position in which a screw 11 that anchors the outer profile 7 to the rear wall 5 of the body 1 is accessible through one of the apertures 9 (said screw 11 is indicated by a dashed line in FIG. 3 because it is concealed by the strip 8). The screw 11 has a head diameter which is slightly smaller than the dimensions of the apertures 9, such that when the rail 8 is suitably raised, the screw 11 can be inserted through the aperture 9 into the interior of the support rail 6 and inserted into a screw hole on the rear side, in order thus to anchor the support rail 6 to the rear wall 5.

A plurality of screws 11 are generally provided at each support rail 6 in order to fix it to the rear wall 5 at a plurality of points distributed over its height so as to prevent parts of the support rail 6 from bulging out due to the turning moment produced by supporting arms 10 engaged therein, and from projecting beyond the internal surface of the rear wall 5.

The screw holes on the rear side of the outer profile 7 are positioned such that they are only ever accessible when the strip 8 is raised, whereas the screw holes and the screws 11 fixed therein are concealed behind the strip 8 in a lowered position of the strip 8 when this is supported at a bottom end of the support rail 6.

The supporting arms 10 of a shelf 13 can be implemented as discrete elements which can be hung in the support rails 6 and extend over a large part of the depth of the inner container 3 such that the shelf 13 can be loosely placed thereon as indicated in the illustration in FIG. 1.

According to a preferred development, as shown in FIG. 2, the supporting arms 10 simultaneously represent longitudinal struts of a frame 14 which comprises two longitudinal struts and two lateral struts 15 and encloses a support plate 16, e.g. a sheet of safety glass. The figure shows fragments of the rear lateral strut 15, the left-hand longitudinal strut 10 and the support plate 16.

Figure 4:
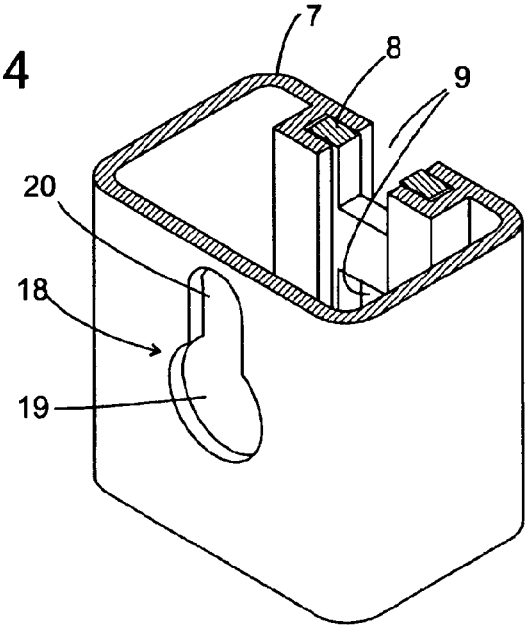
FIG. 4 shows a perspective view of a rail section, seen from its rear side which faces an inner container wall of the refrigeration appliance, according to a modified embodiment.

FIG. 4 shows a perspective view of a preferred development of the support rail 6. Said support rail 6 is identical in cross-section to that shown in FIG. 2. Screw holes 18 having a keyhole-like shape, having in each case a wide lower section 19 and a narrower upper section 20, are formed on a rear side of the outer profile 7. The lower section 19 is dimensioned such that a head of the screw 11 serving to fasten the support rail 6 to the body 1 can pass through it freely, whereas the narrower section 20 is dimensioned to allow only a shaft of the screw 11 to pass. The support rail 6 is slightly shorter than the groove 12 which accommodates it in the rear wall 5 of the body 1. Consequently, it is possible to mount the support rail 6 by first screwing the screws 11 into the rear wall 5, and then putting the support rail 6 over the screws 11 such that their heads pass through the lower section 19 of the screw holes 18 in each case, and then lowering the support rail 6 which is now located in the groove 12 of the rear wall 5, such that the shafts of the screws 11 engage in the narrower sections 20 of the screw holes 18. In this position the strip 8 is in turn raised in order to allow access to the heads of the screws 11, and the screws 11 are tightened with the aid of a tool which is inserted through one of the apertures 9. Since in the case of this variant the screws 11 themselves do not have to pass through the apertures 9, the apertures 9 can be made smaller and the width of the intermediate space between the two limbs of the outer profile 7 guiding the strip 8 can be made narrower than in the case of the embodiment according to FIG. 2, thereby improving the load bearing capacity of the support rail 6.

Figure 5:
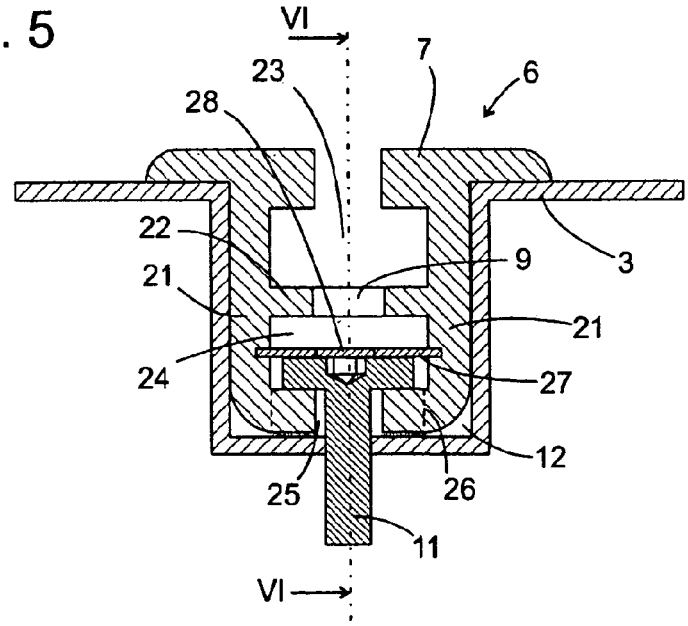
FIG. 5 shows a horizontal section through a vertical rail and its surroundings according to a further embodiment.

FIG. 5 shows a horizontal section through a support rail 6, and a piece of the inner container 3 on which it is mounted, according to a further embodiment of the invention. Here, an outer profile 7 of the support rail 6 has two parallel side walls 21 which are connected to each other in the form of an H by means of a transverse bridge 22. Apertures 9 for receiving hooks of a supporting arm 10 (not shown in the figure) are formed at regular intervals in the transverse bridge 22. The transverse bridge 22 forms the base surface of an undercut groove 23 which is open toward the interior. A second undercut groove 24 is provided on that side of the transverse bridge 22 which faces away from the interior.

Facing toward the inner container 3, an entry gap 25 of the groove 24 has a width which is such that a shaft but not a head of a fastening screw 11 can pass through. Only at some points in the entry gap 25, indicated by dashed delimiting lines in FIG. 5, are widenings 26 provided which, like the lower section 19 of the opening 18 in FIG. 4, are wide enough also to allow a screw head to pass through. It is therefore possible to mount the support rail 6 from FIG. 5 on the rear wall 5 in the same way as described above for the embodiment according to FIG. 4.

A pair of opposing slots is formed in the two side walls 21, and a narrow strip 27 is guided therein in such a way that it can be vertically displaced. The strip 27 divides the inside of the groove 24 into a rear region which accommodates the heads of the screws 11 and a front region which accommodates the hooks of supporting arms 10 that project through the apertures 9.

The strip 27 is provided with a plurality of holes 28 which, when the strip 27 is in a lowered position, are located in each case just below an aperture 9 of the transverse bridge 22 and as a result are not visible from the interior of the refrigeration appliance. However, the strip 27 can be raised to a position in which the holes 28 align in each case with one of the apertures 9, and the head of a screw 11 which is situated behind these can be accessed by a tool through this aperture 9 and the corresponding hole 28, in order to fasten or loosen the support rail 6 on the inner container 3. During normal use of the refrigeration appliance, closed regions of the strip 27 are located in front of the screws 11 in each case, such that none of the latter is visible.

The support rails 6 illustrated in FIGS. 2 and 5 can be mounted onto the body 1 of the refrigeration appliance as described above, in order that supporting arms 10 for shelves can be hung thereon. However, they can also be hung onto the inside of a door of the refrigeration appliance, in order that door storage units can be hung thereon as shown in FIGS. 6 and 7.

Figure 6:
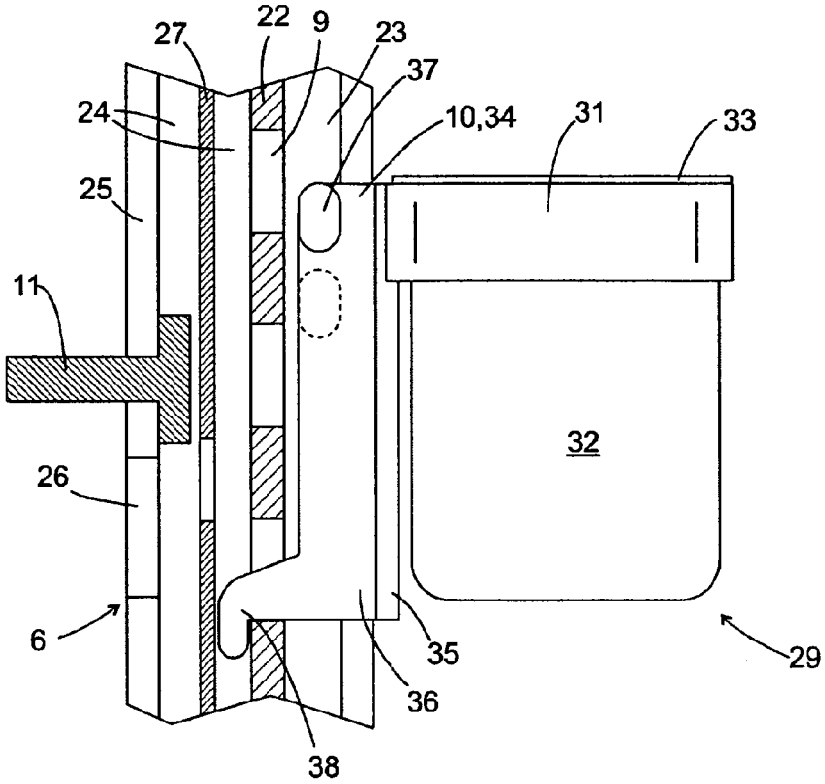
FIG. 6 shows a vertical section along the plane which is designated as VI in FIG. 5 and FIG. 7.
Figure 7:
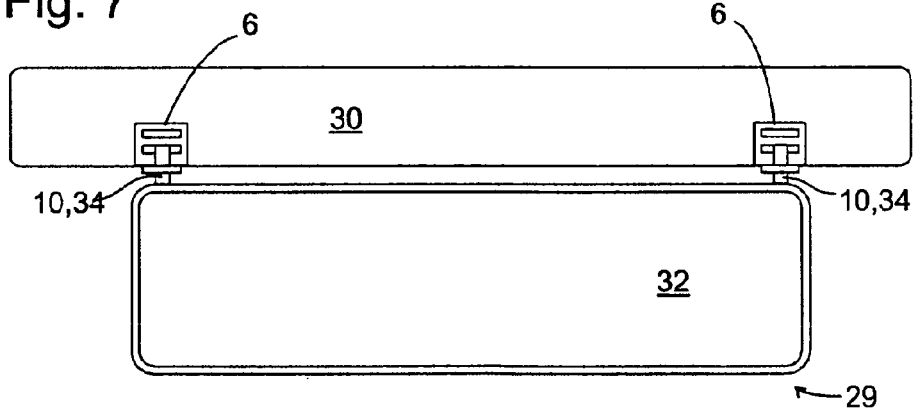
FIG. 7 shows a schematic horizontal section through a refrigeration appliance door in which vertical rails of the type shown in FIG. 5 are mounted.

FIG. 6 is a vertical section through the rail 6 from FIG. 5, wherein a supporting arm 10 which is hung onto the rail, and the door storage unit 29 being held by said arm, are shown in a side view. In this case the supporting arms 10 that engage into the two support rails 6 of the door 30 are in each case rigidly connected to a rectangular frame 31 in which a box 32 of injection molded plastic is loosely hung in order to form the door storage unit. A peripheral rim 33 of the box rests on the frame 31.

The supporting arms 10 comprise in each case a guide body 34 of T-shaped cross-section, having a transverse bar 35 which abuts the outside of the support rail 6, and a rib 36 which projects from the middle of the transverse bar 35 and engages into the groove 23 of the support rail 6. Pegs 37 projecting in opposite directions are formed at a top end of the rib 36 and engage in the undercuts of the groove 23 in each case. A hook 38 which engages into an aperture 9 of the transverse bridge 22 projects from a bottom end of the rib 36.

In order to change the height of the door storage unit 29 it is sufficient to raise the unit comprising frame 31 and supporting arm 10 slightly, and to swivel it counterclockwise with reference to FIG. 6, such that the two hooks 38 are released from the apertures 9, while the pegs 37 remain caught in the groove 23. If care is taken during the swiveling to ensure that at least the hooks 38 do not come out of the grooves 23, it is not possible, due to the rigid connection between the supporting arms 10 via the frame 31, to raise or lower one of the supporting arms 10 significantly more than the other. Canting of the door storage unit 29 when changing its height is therefore prevented to a large extent.

As shown in FIG. 6, the pegs 37 can have an eccentric cross-section. It is conceivable to lengthen the pegs 37 so much in a vertical direction that they restrict the freedom of swiveling movement of the unit comprising frame 31 and supporting arms 10 to such an extent that the hooks 38 can no longer come out of the grooves 23. A plurality of pegs arranged on a same side of the ribs 36, or pegs offset in height relative to one another on opposite sides, as indicated by a dashed outline 37' in FIG. 6, can also be used for the same purpose.

Figure 8:
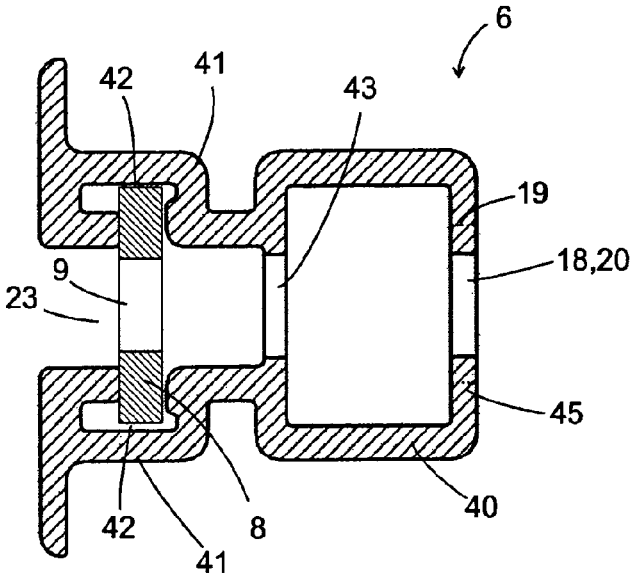
FIG. 8 shows a cross-section of a rail according to a development of the embodiment from FIG. 4.

FIG. 8 shows the cross-section of a support rail 6 which again develops the principle described with reference to FIG. 4. The support rail 6 has a main body in the form of a four-edged profile 40, which is provided for attachment to the base of a groove in a wall of the refrigeration appliance, and from which, on one of its four walls designated as 44, two limbs 41 project and delimit a groove 23 which is open toward the interior of the refrigeration appliance. The limbs 41 have a multi-angled profile and delimit undercuts 42 which branch off from the groove 23 and are provided for the purpose of accommodating a bridge 8 in such a way that it can be vertically displaced, said bridge 8 having apertures 9 as shown in FIG. 4.

Keyhole-shaped openings 18 are vertically distributed on a rear wall 45, which faces away from the limbs 41, of the four-edged profile 40. Each keyhole-shaped opening 18 corresponds to a hole 43 in the front wall 44 of the four-edged profile 40, at the base of the groove 23 between the limbs 41.

Figure 9:
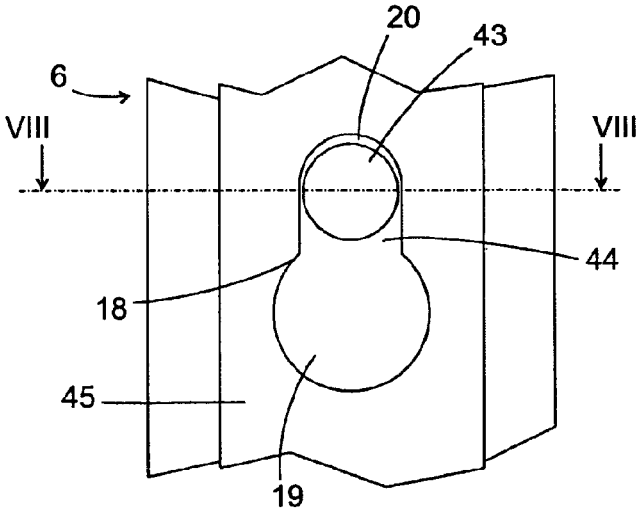
FIG. 9 shows a fragment of the rail from FIG. 8, seen from its rear side.

FIG. 9 shows a fragment of the support rail 6, seen from the rear side, at the height of one of the keyhole-shaped openings 18. The hole 43 in the front wall of the four-edged profile 40 is located at the height of the narrower section 20 of the opening 18; the front wall 44 is closed at the height of the further section 19 of the opening 18. A screw which is inserted through the section 19 into the opening 18 from behind is therefore only visible from the front when it engages in the narrower section 20 and its head arrives at the height of the hole 43. The hole 43 is slightly narrower here than the narrower section 20 of the opening 18, such that even if the screw is aligned exactly with the hole 43, it is never possible to see its whole head through the hole 43, but at the most a contour of the screw head to which a tool can be applied for the purpose of turning the screw.

Figure 10:
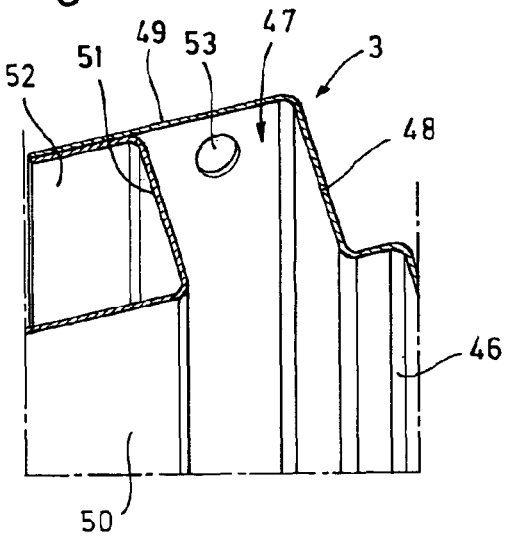
FIG. 10 shows a section from the inner container of a refrigeration appliance in a first phase of its assembly.

FIG. 10 shows a perspective view of a fragment of the inner container 3. In this case the inner container 3 is assembled from a plurality of sheets, a side wall sheet 46 which, while embodying a plurality of steps, forms a side wall 48 and a base 49 of a vertical groove 47, said base 49 being parallel to the rear wall of the inner container 3, and a rear wall sheet 50 which is angled twice to form a second side wall 51 of the groove 47 and a fastening strap 52 which is connected to the base 49 by means of, for example, spot welding. An opening 53 in the base 49 is provided for receiving a screw.

Figure 11:
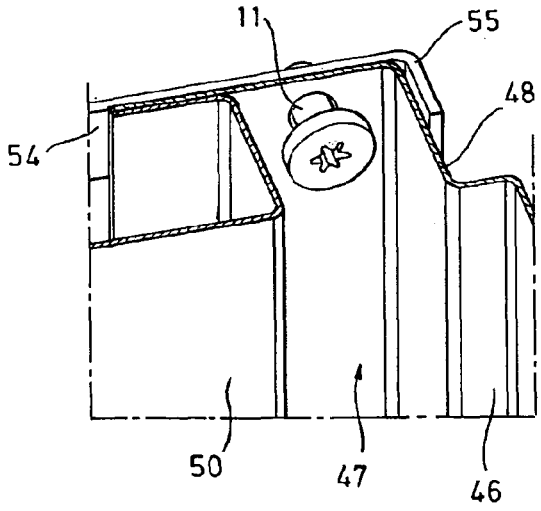
FIG. 11 shows the section from FIG. 10 in a second assembly phase.
Figure 12:
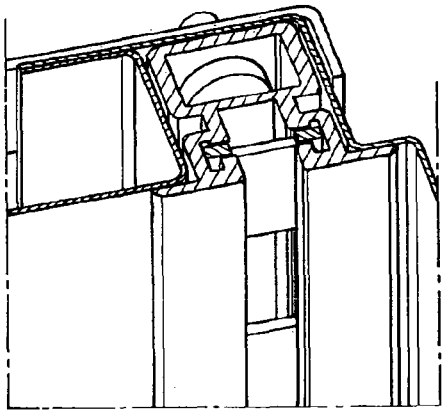
FIG. 12 shows the section from FIG. 10 in a third assembly phase.

As shown in FIG. 11, in a subsequent phase of the assembly of the refrigeration appliance, the screw 11 engages through the opening 53 into a thread of a reinforcing stay 54 that essentially extends over the entire width of the rear wall of the inner container 3 and has at its ends two angled straps 55, each of which grips around the side walls 48, these being formed by the side wall sheets 46, of the grooves 47 that are formed symmetrically and adjacent to the two side walls of the inner container 3. FIG. 11 shows the screw 11 in a position which is partially screwed in; it is screwed in until its head comes into contact with the base 49, in order to seal the opening 53 fully and to hold the reinforcing stay 54 pressed firmly against the rear wall.

The hollow space delimited by the inner container 3 and the outer skin 2 is then filled with foam. Because the screw holds the reinforcing stay 54 against the base 49 in a close and tight-fitting manner, the opening can have a larger diameter than the shaft of the screw, without sealing problems arising as a result of this.

After the foam material has been introduced and set, the screw 11 can be slackened or even temporarily removed, since the reinforcing stay 54 is held in place by the foam. In the case of the support rails 6 shown in FIGS. 4 and 8 respectively, it is sufficient to slacken the screw 11 to such an extent that one of the keyhole-shaped openings 18 can be pulled over the screw 11 and the support rail 6 then vertically displaced in order to engage the screw 11 in the narrower section 20 of the opening 18. In the case of the support rail from FIG. 8, the head of the screw becomes accessible through the hole 43 as soon as the support rail 6 has reached its intended position in the groove 47, such that only in this position can the screw 11 be tightened and the support rail 6 fixed.

The invention claimed is:

1. A cabinet-like household appliance, the household appliance comprising:

at least two walls, the walls delimiting an interior; and a height-adjustable support system mounted in the interior, the support system including a vertical rail including a profiled element and a strip, the profiled element being fixed to a first one of the walls by at least one fastener, and the strip being vertically displaceable in the profiled element between a first position in which the at least one fastener is accessible through an opening in the strip and a second position in which the at least one fastener is substantially concealed behind the strip;

a plurality of locating steps on the vertical rail; and at least one supporting arm having at least one projection, the at least one projection being engageable in one of the locating steps on the vertical rail, wherein the strip is vertically displaceable in the profiled element between the first position and the second position when the profiled element is fixed to the first one of the walls in a normal operating position of the household appliance.

2. The household appliance as claimed in claim 1, wherein the locating steps are apertures, and the at least one fastener is accessible through one of the apertures.

3. The household appliance as claimed in claim 1, wherein the locating steps are formed in the strip.

4. The household appliance as claimed in claim 1, wherein the locating steps are formed in a bridge of the profiled element and the strip is arranged between the wall supporting the rail and the bridge.

5. The household appliance as claimed in claim 1, wherein a mounting opening is provided on a side of the profiled element that faces the first wall and, when the at least one fastener is loosened, the profiled element on the first wall can be displaced between a position in which a head of the at least one fastener passes through a wide entry section of the mounting opening and a position in which the head is caught in a narrow section of the mounting opening.

6. The household appliance as claimed in claim 5, wherein the profiled element has a hole in an inner wall that is parallel to the side having the mounting opening, the hole being aligned with the narrow section of the mounting opening.

7. The household appliance as claimed in claim 6, wherein the hole is smaller than the head of the at least one fastener.

8. The household appliance as claimed in claim 1, wherein the locating steps are arranged on a base surface of an undercut groove of the vertical rail, the groove being open toward the interior, and one of the at least one projection is held in the undercut groove.

9. The household appliance as claimed in claim 1, wherein the vertical rail is fastened to a door of the household appliance.

10. The household appliance as claimed in claim 1, wherein the vertical rail is fastened within a body of the household appliance.

11. The household appliance as claimed in claim 1 and further comprising a second vertical rail and two supporting arms that are connected to a rigid unit, and at least one of the rails has a vertical groove that is open toward the interior and into which a guide projection of one of the supporting arms extends.

12. The household appliance as claimed in claim 11, wherein the guide projection has a vertical extent of at least 5 cm.

13. The household appliance as claimed in claim 11, wherein the supporting arms carry a door storage unit and the guide projection has a vertical extent which corresponds to the height of the door storage unit.

14. The household appliance as claimed in claim 11, wherein the projection engaging into the locating steps forms at least a part of the guide projection.

15. The household appliance as claimed in claim 1, wherein the wall includes an outer skin, an inner container, and an insulating material layer disposed therebetween, and the inner container is reinforced at the height of the at least one fastener by a plate that is arranged between the inner container and the insulating material layer.

16. The household appliance as claimed in claim 15 and further comprising a thread that holds the at least one fastener formed in the plate.

* * * * *